United States Patent [19]

McCrimmon, Jr. et al.

[11] Patent Number: 4,854,756

[45] Date of Patent: Aug. 8, 1989

[54] ADAPTIVE PRINT HAMMER TIMING SYSTEM

[75] Inventors: Kenneth A. McCrimmon, Jr., El Toro; Matthew M. Chu, Santa Ana, both of Calif.

[73] Assignee: Printronix, Inc., Irvine, Calif.

[21] Appl. No.: 80,769

[22] Filed: Aug. 3, 1987

[51] Int. Cl.[4] ..... B41J 3/12

[52] U.S. Cl. ..... 400/322

[58] Field of Search ..... 400/279, 282, 283, 320, 400/323, 328

[56] References Cited

U.S. PATENT DOCUMENTS

| | | | |
|---|---|---|---|
| 3,941,051 | 3/1976 | Barrus et al. | 101/93.04 |
| 4,119,383 | 10/1978 | Watanabe et al. | 400/320 |
| 4,232,975 | 11/1980 | Kane | 400/322 |
| 4,275,968 | 6/1981 | Irwin | 400/126 |
| 4,359,289 | 11/1982 | Barrus et al. | 400/322 |
| 4,415,286 | 11/1983 | Jennings | 400/279 |
| 4,421,431 | 12/1983 | Dorrfub et al. | 400/303 |
| 4,459,050 | 7/1984 | Goldberg et al. | 400/322 |
| 4,459,675 | 7/1984 | Bateson et al. | 400/320 |
| 4,463,300 | 7/1984 | Mayne et al. | 318/687 |
| 4,468,140 | 8/1984 | Harris | 400/322 |
| 4,517,503 | 5/1985 | Lin et al. | 400/279 |
| 4,522,517 | 6/1985 | Wade et al. | 400/320 |
| 4,527,920 | 7/1985 | Mako | 400/322 |
| 4,683,818 | 8/1987 | Howlett, Jr. | 400/322 |

*Primary Examiner*—William Pieprz

*Attorney, Agent, or Firm*—Scherlacher, Mok & Roth

[57] ABSTRACT

In a printer in which an elongated shuttle is driven in reciprocating fashion across a print paper with hammers mounted along the length of the shuttle being selectively fired to print dots on the paper, a timing system provides hammer fire pulses denoting the positions of the shuttle at which hammer firing should be initiated to print in the proper dot positions. Proper timing is maintained so as to allow for printing during acceleration and deceleration as well as during constant velocity movement of the shuttle by determining the average shuttle velocity between each successive pair of fence post pulses generated by a shuttle-coupled encoder. The average velocities are represented by the time lapses between occurrence of the pairs of fence post pulses which are measured and stored during each startup of the printer as well as each time the nominal operating shuttle velocity is changed as part of a change in printer operation. Dot positions are represented by a percentage of the distance between a pair of fence post pulses, such that the time of occurrence of each dot position following the immediately prior fence post pulse can be determined by applying the percentage to the stored time lapse between the pair of pulses. The time position of each dot position as so determined is stepped back by the fixed hammer flight time to arrive at the hammer fire pulse times which are referenced to the immediately prior fence post pulse and which are used during each stroke of the shuttle.

16 Claims, 4 Drawing Sheets

ADAPTIVE PRINT HAMMER TIMING SYSTEM

BACKGROUND OF THE INVENTION

1. Field of the Invention

The present invention relates to dot matrix line printers, and more particularly to printers of that type in which a plurality of hammers mounted along the length of a reciprocating shuttle are selectively released in synchronism with the constantly changing position of the shuttle to print dots on an adjacent print paper.

2. History of the Prior Art

Dot matrix line printers are known in which a plurality of hammers mounted along the length of a shuttle which undergoes reciprocating motion relative to a length of print paper are selectively fired to print dots on the paper. An example of such a printer is provided by U.S. Pat. No. 3,941,051 of Barrus et al., PRINTER SYSTEM, which patent issued Mar. 2, 1976 and is commonly assigned with the present application. The printer described in the Barrus et al. patent includes an encoder which generates "fence post" pulses in response to movement of the printer shuttle past a succession of generally equally spaced positions along the stroke of the shuttle. The fence post pulses provide a representation of the actual position of the shuttle relative to the print paper and are used in the timing of hammer firing.

In printers of the type described in U.S. Pat. No. 3,941,051 of Barrus et al. in which the printing is accomplished in dot matrix fashion, the various dot positions across the print paper can be referenced to the fence post pulses so that the fence post pulses can be used to time hammer firing. To do this, each dot position is related to the fence post pulse which occurs immediately prior thereto during movement of the shuttle. The time lapse between the immediately prior fence post pulse and the dot position can be related to the known hammer flight time so as to arrive at a hammer firing point which is related to one of the fence post pulses and which will produce printing of a dot at the dot position. The hammer flight time is the known time lapse between initiation of hammer firing and actual impact of the hammer with the paper.

It is known to provide printers of the type described with a variable dot density. In such instances the circuit for generating the hammer fire pulses must be capable of referencing the different dot positions corresponding to the different dot densities to the fence post pulses so that the hammer fire pulses can be varied as necessary in accordance with each change in dot density. An example of an arrangement for accommodating different dot densities in this fashion is provided by U.S. Pat. No. 4,415,286 of Jennings, VARIABLE PRINT DENSITY ENCODER SYSTEM, which patent issued Nov. 15, 1983 and is commonly assigned with the present application. As described in the Jennings patent, a stored initial offset value is used to initially establish a desired phase relationship between the hammer fire pulses and the fence post pulses. Thereafter, a stored pulse interval value is used to generate the hammer fire pulses at the desired frequency. The desired phase relationship is maintained by measuring the time distance between selected ones of the hammer fire pulses and the preceding fence post pulses, comparing the measured time interval with a stored value representing the desired offset and applying any difference as an error signal to alter the time interval between the immediately following pair of hammer fire pulses.

In the printer described in th previously referred to U.S. Pat. No. 3,941,051 of Barrus et al., the shuttle is driven in reciprocating fashion by a rotating cam which continuously engages the pulley of a spring-loaded cam follower attached to the shuttle. This provides the shuttle with a trapezoidal velocity profile. Each stroke of the shuttle is characterized by the rapid acceleration thereof in generally linear fashion to a relatively constant nominal velocity which is maintained during most of the stroke. At the end of the stroke the shuttle decelerates to rest rapidly and in generally linear fashion. Because the shuttle moves at the relatively constant nominal velocity during a substantial portion of each stroke, printing can be confined to the constant velocity region for most applications of the printer. Moreover, even if printing were carried out during acceleration and deceleration of the shuttle, the timing of hammer firing could be done in reliable fashion because of the predictable nature of the cam drive and the relatively precise shuttle velocity profile which can be assumed therefrom.

The problem of providing reliable hammer fire signals becomes more serious where the shuttle is driven in reciprocating fashion by arrangements which do not employ a cam drive. For example, in the previously referred to U.S. Pat. No. 4,415,286 of Jennings, the shuttle and an associated counterbalancing element are disposed on the opposite sides of a pair of spaced-apart rotatable pulleys so as to function as a linear motor. An arrangement of permanent magnets and coils drives the shuttle and the counterbalancing element in reciprocating fashion with the counterbalancing element or the shuttle or both rebounding from resilient elements such as springs to effect the rapid turnaround thereof.

A similar linear motor arrangement is described by U.S. Pat. No. 4,463,300 of Mayne et al., LINEAR MOTOR DIGITAL SERVO CONTROL, which patent issued July 31, 1984 and is commonly assigned with the present application. Such arrangements drive the shuttle in accurate and controlled fashion during the constant velocity portion of each stroke of the shuttle assembly. However, during each turnaround in which the shuttle is decelerated to rest, reversed in direction and then accelerated back up to the constant nominal velocity, relatively little control is exercised over the arrangement so that the precise behavior of the shuttle during turnarounds is difficult to predict. The Mayne et al. patent, for example, describes an arrangement for driving the shuttle through the turnaround which applies a single drive signal at the start of each turnaround. The drive signal is continuously updated in accordance with the constantly changing characteristics during the turnarounds.

Compounding the problem of accurate shuttle control and the generation of accurate hammer fire pulses in shuttle drives of the type referred to in the previously referred to Jennings and Mayne et al. patents is the fact that such linear motor arrangements have a velocity profile which is more sinusoidal in nature than in the case of a cam driven shuttle and in which the constant velocity portion of each stroke is somewhat shortened. This reduces the portion of each stroke over which printing can be performed unless the printing region of the stroke is extended into the acceleration and deceleration portions thereof The timing of hammer firing during acceleration and deceleration is not a major problem so long as the velocity as well as the position of the shuttle are closely monitored. However, such close monitoring typically requires rather complex circuitry to achieve. Alternatively, the velocity characteristics of the shuttle during acceleration and deceleration can be approximated by the storage and continuous use of permanent values representative thereof. This frequently results in timing errors, however, because of the lack of close control in such systems which do not employ a constantly engaged cam and in which the rebounding mechanisms and other components may vary with time so as to change the velocity characteristics of the shuttle in the regions of acceleration and deceleration.

Accordingly, it would be advantageous to provide an improved print hammer timing system for generating hammer fire pulses. It would furthermore be advantageous to provide such an improved system in which shuttle velocity during acceleration and deceleration can be predicted with reasonable accuracy and without the need for complex circuitry. It would still furthermore be advantageous to provide an adaptive print hammer timing system in which stored values representing shuttle velocity are periodically updated at a rate which takes into consideration changes in the gradually varying characteristics of the shuttle drive system.

BRIEF DESCRIPTION OF THE INVENTION

The foregoing and other objects and features are accomplished in accordance with the invention by providing an adaptive print hammer timing system in which stored values representing the predictable velocity of the shuttle along the printing region of each shuttle stroke are updated each time the printer is started up. Preferably, the stored values are also updated each time the nominal operating velocity of the shuttle is changed such as due to a mode change of the printer. In this manner changes in the printer which affect the velocity characteristics of the shuttle during the acceleration and deceleration regions of its stroke are compensated for.

Timing systems in accordance with the invention utilize a succession of position pulses such as the fence post pulses generated by an encoder as the shuttle undergoes each stroke of its reciprocating movement. The occurrence of each fence post pulse represents the arrival of the shuttle at one of a succession of generally equally spaced positions along the stroke. During printer startup or when the nominal operating velocity of the printer is being changed, the time intervals between fence post pulses are examined to determine the velocity of the shuttle between different pairs of the pulses and such information is stored.

The various dot positions along each stroke of the shuttle are represented as percentages of the total distances between the different pairs of fence post pulses at which the dot positions occur. The stored velocity information is multiplied by the percentages to determine the time interval between each dot position and the immediately preceding fence post pulse. A representation of this interval is then combined with a fixed hammer flight time to determine the point in time where each hammer fire pulse occurs in relation to the immediately preceding fence post pulse. The fixed hammer flight time is the time between initiation of hammer firing and impact of the print paper by the hammer.

It has been found that the hammer fire pulses can be generated with reasonable accuracy during regions of low shuttle acceleration and deceleration on opposite sides of the nominal operating velocity region of each stroke by periodically determining and storing a representation of the average velocity between each pair of fence post pulses. This is done each time the printer is started up or its mode of operation is changed. The average velocity is determined by measuring the time interval between the occurrence of each pair of fence post pulses and storing a representation of that interval. The percentages representing the occurrence of dot positions within each interval can then be multiplied by the interval to arrive at the time between the dot position and the first or preceding one of the two fence post pulses with reasonable accuracy and without further velocity measurements while the printer continues to operate at the nominal operating velocity.

In a preferred embodiment of an adaptative print hammer timing system in accordance with the invention, a shuttle having an encoder coupled thereto to generate fence post pulses during each stroke of the shuttle is operated as a linear motor. The shuttle and an elongated counterbalancing element are disposed on the opposite sides of a pair of spaced-apart pulleys and are driven by a partly stationary and partly moving arrangement of permanent magnets and coils. Rebounding of the shuttle at the ends of the strokes thereof is provided by a pair of rubber bumpers.

During printer startup and each time the nominal operating velocity of the shuttle is changed, a fence period timer is employed to measure the time interval or fence period between each pair of fence post pulses. The fence periods are stored in a dynamic fence period table. A static dot position table represents each dot position of a given dot density in terms of a percentage of the distance through one of the fence periods at which the dot position occurs. Each fence period stored in the dynamic fence period table is multiplied by the percentage or percentages pertaining thereto which are stored in the static dot position table to provide a succession of dynamic dot position values. The dynamic dot position values are adjusted forward in time by the fixed hammer flight time using an adder, to produce hammer fire times which are then stored in a dynamic hammer fire time table. The hammer fire times which are referenced to the immediately preceding fence post pulses are loaded into a hammer fire timer which then produces the hammer fire pulses at the appropriate times following the occurrence of the various fence post pulses.

BRIEF DESCRIPTION OF THE DRAWINGS

A better understanding of the invention may be had by reference to the following description taken in conjunction with the accompanying drawings, in which.

Figure 1:
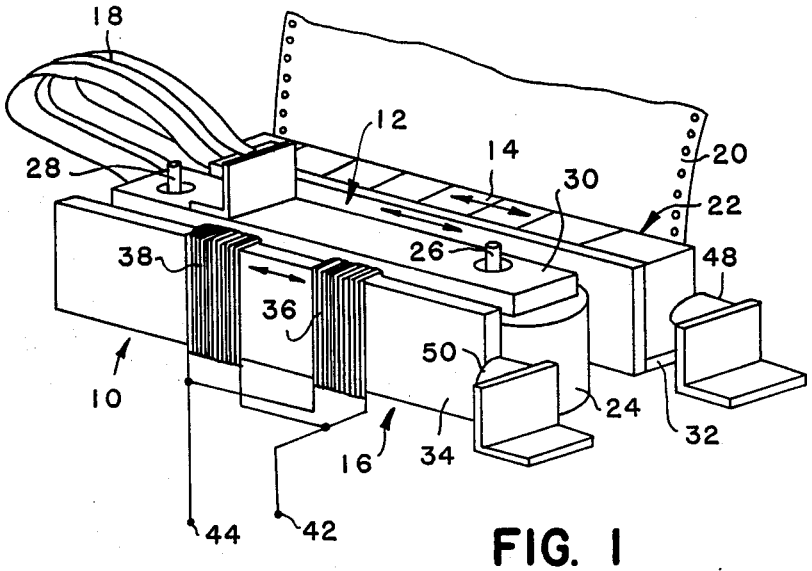
FIG. 1 is a perspective view of a portion of a printer utilizing an adaptive print hammer timing system in accordance with th invention.
Figure 5:
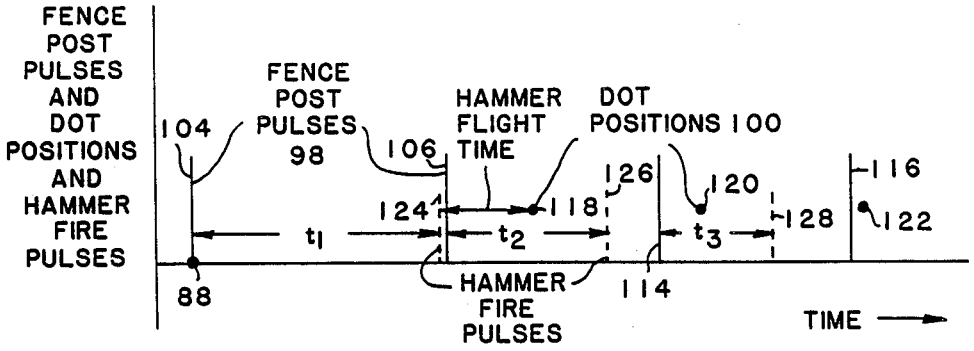
Figure 6:
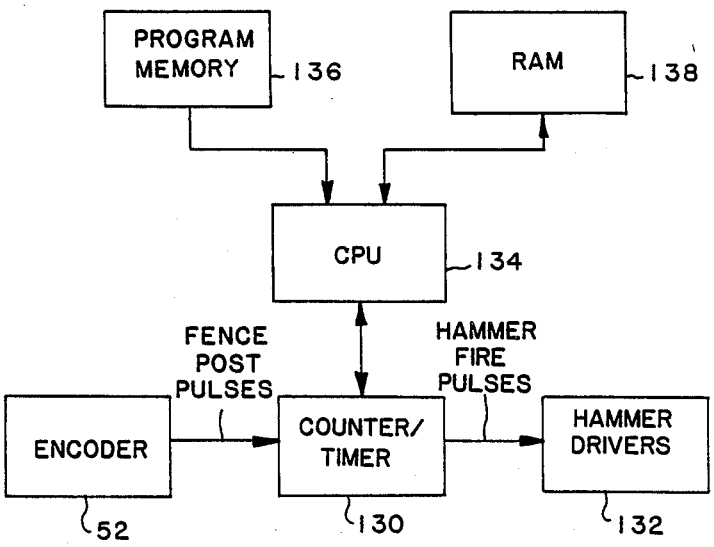
Figure 7:
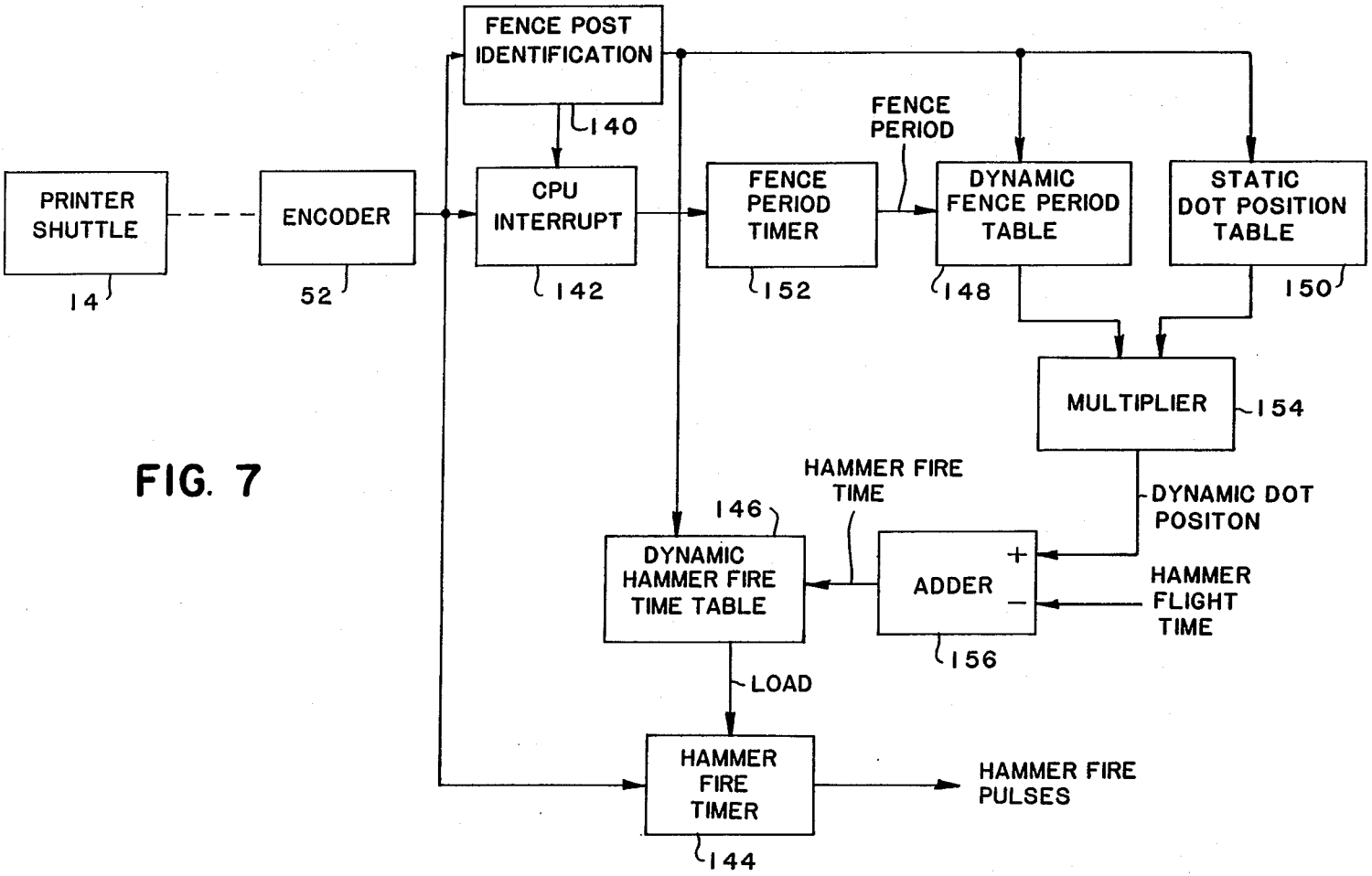

1 as a function of time and illustrating the manner in which shuttle velocity is periodically averaged;

FIG. 5 depicts fence post pulses, dot positions and hammer fire pulses of the arrangement shown in FIG. 1 as a function of time, over a small portion of the acceleration region of a stroke;

FIG. 6 is a basic block diagram of a circuit for controlling the arrangement shown in FIG. 1 including an adaptive print hammer timing system in accordance with the invention; and FIG. 7 is a detailed block diagram of the adaptive print hammer timing system of the circuit of FIG. 6.

DETAILED DESCRIPTION

FIG. 1 depicts a portion of a printer 10 having a shuttle drive 12 which includes an elongated shuttle 14 and a linear motor 16. The shuttle drive 12 and the included shuttle 14 and linear motor 16 are shown and described in greater detail in U.S. Pat. No. 4,359,289 of Barrus et al., COUNTERBALANCED BIDIRECTIONAL SHUTTLE DRIVE HAVING LINEAR MOTOR, which patent issued Nov. 16, 1982 and is commonly assigned with the present application.

A wire bus 18 is coupled to the shuttle 14 to provide electrical connection therewith. As described in U.S. Pat. No. 4,359,289 of Barrus et al., the shuttle 14 selectively impacts and thereby imprints on a print paper 20 by a length of ink ribbon (not shown) disposed between the shuttle 14 and the print paper 20. Such impact printing occurs as the shuttle 14 undergoes reciprocating motion along a linear path of motion relative to the print paper 20. The print paper 20 is incremented upwardly through a print station 22 defined by a narrow, elongated space adjacent the shuttle 14.

The shuttle drive 12 includes a pair of opposite, spaced-apart, rotatable pulleys with one of the pulleys 24 being shown in FIG. 1. The pulleys are mounted for rotation about a pair of spaced-apart, generally parallel vertical axes. The pulley 24 is mounted for rotation by a shaft 26 and the opposite pulley is mounted for rotation by a shaft 28. The shafts 26 and 28 are journaled in the opposite ends of a top frame 30 as well as in a bottom frame which is hidden from view in FIG. 1.

The shuttle 14 is mounted on a generally L-shaped shuttle mounting frame 32 having opposite ends disposed in contact with the pulley 24 and the opposite pulley on one side of the pulleys. An elongated counterbalancing bar 34 is disposed in contact with the pulleys on opposite sides of the pulleys from the mounting frame 32. The mounting frame 32 and the counterbalancing bar 34 are held in contact with the pulleys by a band (not shown) which encircles the pulleys and attaches to the frame 32 and the bar 34. The mounting frame 32 and the counterbalancing bar 34 are also held in contact with the pulleys by the attractive force of a magnet assembly forming a portion of the linear motor 16. The linear motor 16 includes a pair of coils 36 and 38 mounted on the counter-balancing bar 34 and having leads which terminate in a pair of terminals 42 and 44.

Opposite limits of movement of the shuttle drive 12 along its linear path of motion are defined by a pair of rubber stops 48 and 50 mounted adjacent the ends of the shuttle 14 and the counterbalancing bar 34. The rubber stops 48 and 50 are alternately impacted by the shuttle 14 and the counterbalancing bar 34 respectively as the shuttle 14 and the counterbalancing bar 34 reciprocate in response to energization of the coils 36 or 38.

Figure 2:
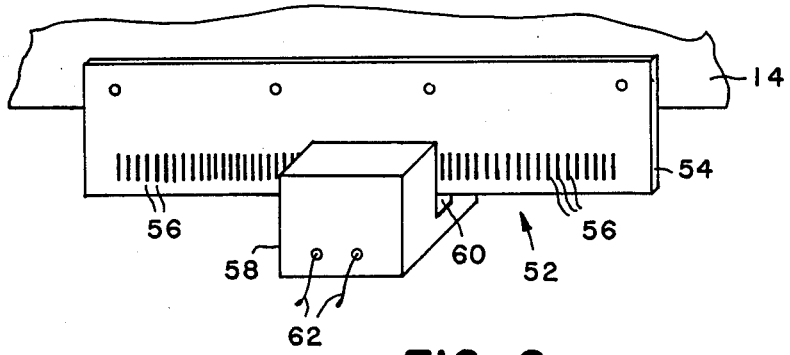
FIG. 2 is a perspective view of an encoder forming a part of the arrangement shown in FIG. 1.

FIG. 2 depicts an encoder 52 which is coupled to the shuttle 14 of FIG. 1 and which generates signals in the form of fence post pulses representing the position of the shuttle 14 as it reciprocates through the opposite strokes thereof. The encoder 52 includes an elongated plate 54 attached to the shuttle 14 and having a succession of generally equally spaced slots 56 therein adjacent a lower edge of the plate 54. A generally U-shaped sensor assembly 58 is fixedly mounted within the printer 10 below the shuttle 14 and has a central opening 60 therein for receiving the lower edge of the plate 54. The encoder 52 is of conventional configuration in that it includes a light emitting source such as a light emitting diode in the sensor assembly 58 on one side of the central opening 60 and an opposite light sensor on the opposite side of the central opening 60. Each time one of the slots 56 passes therebetween, a fence post pulse is provided at a pair of leads 62.

As will be seen from the discussion to follow, the generally equally spaced slots 56 along the plate 54 produce a succession of fence post pulses which are generally equally spaced in terms of the time of occurrence thereof and the resulting fence period therebetween when the shuttle 14 is moving along a stroke at a relatively constant velocity. Increases in the speed of the shuttle 14 result in a corresponding shortening in the fence period between each pair of fence post pulses. Conversely, slowing of the shuttle 14 produces a corresponding lengthening of the fence periods between the pairs of fence post pulses. The encoder 52 therefore produces signals representing the passage of each of a succession of generally equally space positions along the stroke of the shuttle by the shuttle 14.

Figure 3:
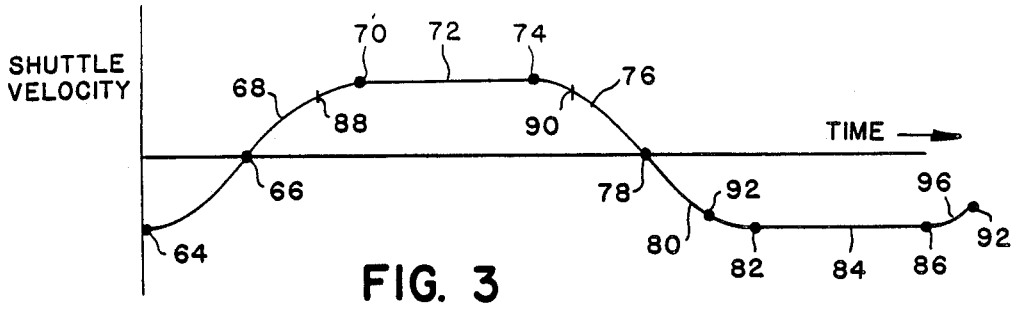
FIG. 3 is a plot of shuttle velocity as a function of time for the arrangement shown in FIG. 1.

FIG. 3 is a plot of the velocity of the shuttle 14 as a function of time. At a point 64 at the extreme left of FIG. 3, the shuttle 14 which is being driven in a given direction by the linear motor 16 begins decelerating in preparation for turnaround. A the shuttle 14 decelerates to rest or zero velocity as represented by a point 66 in FIG. 3 to complete the stroke thereof, the rubber stop 48 is impacted by the shuttle 14 and is compressed as the shuttle 14 comes to rest at the point 66. As the shuttle 14 rebounds from the rubber stop 48 in the opposite direction to begin the next stroke thereof, the shuttle velocity shown in FIG. 3 rises along an acceleration region 68 during the first part of the stroke. The acceleration of the shuttle 14 slows as shuttle velocity levels off. Beginning at a point 70 shuttle acceleration has decreased to zero and the shuttle 14 is driven at a nominal operating velocity by the linear motor 16. The nominal operating velocity of the shuttle 14 at the point 70 is equal to the velocity of the shuttle 14 at the point 64 but is in the opposite direction.

The shuttle 14 is driven at the nominal operating velocity along a constant velocity region 72 by the linear motor 16 until a point 74 is reached at which the linear motor 16 stops driving the shuttle 14 and the shuttle 14 begins decelerating. As the shuttle 14 enters a deceleration region 76, the shuttle 14 begins decelerating slowly at first and then more rapidly as the counterbalancing bar 34 engages and then compresses the rubber stop 50. The shuttle 14 comes to rest at a point 78, following which the compressed rubber stop 50 causes rebounding of the counterbalancing bar 34 and accompanying reversal in the direction of the shuttle 14. As this occurs, the shuttle 14 enters an acceleration region 80 at which the shuttle 14 accelerates rapidly and then more gradually to a point 82 at which the linear motor 16 begins driving the shuttle 14 at the nominal operating velocity. The shuttle 14 continues to be driven at the nominal operating velocity along a constant velocity region 84.

Eventually, the shuttle 14 reaches a point 86 at the end of the constant velocity region 84 at which the linear motor 16 stops driving the shuttle 14. The shuttle 14 then decelerates to rest and reverses direction as the shuttle 14 compresses and then rebounds from the rubber stop 48. The point 86 corresponds to the point 64 in the sense that following the point 86 the velocity of the shuttle 14 repeats in the fashion shown in FIG. 3. The interval between the points 66 and 78 defines a stroke of the shuttle 14 in one direction. The reciprocating movement of shuttle 14 is characterized by a succession of strokes of opposite direction.

During the constant velocity regions 72 and 84 the shuttle 14 is driven by the linear motor 16. The linear motor 16 is servo controlled and uses the fence post pulses generated by the encoder 52 to maintain the nominal operating velocity. The timing of hammer firing which is related to the occurrence of the fence post pulses is made relatively easy because constant velocity and therefore equal fence periods between pairs of fence post pulses can be assumed due to the close servo control of shuttle velocity maintained by the linear motor 16. However, the constant velocity regions 72 and 84 comprise only portions of the shuttle strokes with the remaining portions of such strokes being comprised of the various acceleration and deceleration regions such as the regions 68, 76 and 80. Thus, the shuttle stroke defined by the interval between the points 66 and 78 is comprised of the acceleration region 68, the constant velocity region 72 and the deceleration region 76, with the acceleration and deceleration regions 68 and 76 comprising a substantial portion of such stroke.

Depending upon the requirements of the printer 10, it may be desirable to conduct printing during portions of the acceleration and deceleration regions 68 and 76 as well as during the constant velocity region 72. In the present example, printing is commenced at a point 88 toward the end of the acceleration region 68 where the acceleration of the shuttle 14 begins to slow and then terminate at the point 70. Printing then continues through the constant velocity region 72 and into the deceleration region 76 where printing is terminated at a point 90. The portion of the deceleration region 76 between the points 74 and 90 is characterized by a gradual transition into deceleration from th nominal operating velocity of the constant velocity region 72. In like fashion, printing is begun at a point 92 in the acceleration region 80 of the next shuttle stroke and is terminated at a point 94 within a deceleration region 96 which begins at the point 86 at the end of the constant velocity region 84.

Printing between the points 88 and 90 and the points 92 and 94 during each of the opposite strokes of the shuttle 14 as opposed to merely printing over the constant velocity regions 72 and 84 enhances the speed and versatility of the printer 10 by utilizing a substantial portion of each shuttle stroke for printing. At the same time, however, printing during acceleration and deceleration of the shuttle 14 creates additional problems which are not present when printing only during nominal operating velocity. As previously noted, the velocity of the shuttle 14 is closely controlled by the linear motor 16 using servo control through the constant velocity regions 72 and 84. Within the acceleration and deceleration regions 68, 76, 80 and 96, however, the shuttle 14 is not under the control of the linear motor 16 but instead is accelerating and decelerating on its own with the aid of the rubber stops 48 and 50.

Certain types of shuttle drives such as the cam drive described in previously referred to U.S. Pat. No. 3,941,051 of Barrus et al. in which the rotating cam is in contact with the shuttle at all times provide a predictable shuttle velocity profile which undergoes very little if any change over a long period of use. However, the shuttle drive 12 used with the printer 10 of FIG. 1 herein is subject to variations in the acceleration and deceleration regions because of the absence of contact with or other direct control over the shuttle 14 through these regions. The characteristics of components such as the rubber stops 48 and 50 can change with aging. Moreover, while it has been found that the shuttle velocity characteristic remains essentially constant for a given operation of the printer 10 once the nominal operating velocity has been obtained by the shuttle 14, the velocity characteristic of the shuttle 14 shown in FIG. 3 can actually undergo slight variations between one operation of the printer 10 and the next, or even when the nominal operating velocity of the shuttle 14 is changed such as during a mode change when the printer 10 is already operating.

Figure 4A:
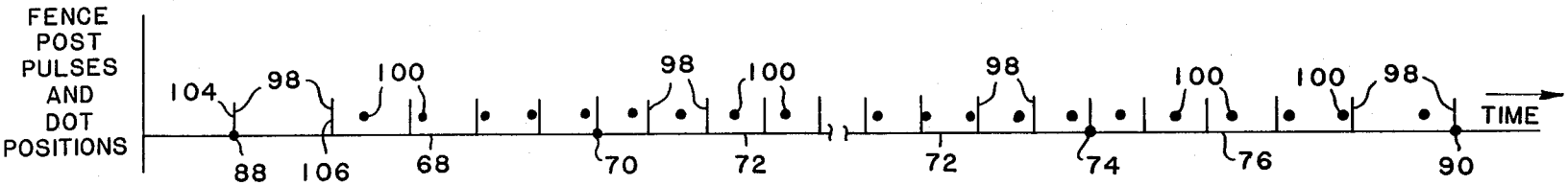
FIG. 4A depicts fence post pulses and dot positions along a stroke of the shuttle of the arrangement shown in FIG. 1 as a function of time.

FIG. 4A depicts the fence post pulses from the encoder 52 as well as dot positions as a function of time between the points 88 and 90 of the shuttle velocity profile of FIG. 3. As previously noted, the encoder 52 generates the fence post pulses in response to the occurrence of the slots 56 in the plate 54 at the sensor assembly 58. Because FIG. 4A is a plot with respect to time rather than distance, fence post pulses 98 shown therein have spaces therebetween which vary in accordance with the velocity of the shuttle 14. Thus, during the portion of the acceleration region 68 between the points 88 and 70 where shuttle velocity is still increasing but is beginning to level off to the nominal operating velocity, the time interval or time distance between each pair of the fence post pulses 98 decreases from a large fence period at the point 88 to a nominal fence period at the point 70 where the nominal operating velocity begins.

The fence periods are essentially constant through the constant velocity region 72. As the point 74 is reached and the shuttle 14 begins to slow upon entry of the deceleration region 76, the fence periods begin to increase up to a relatively large value at the point 90. The fence period at the point 90 is essentially equal to the fence period at the point 88 within the acceleration region 68.

The dot positions for a given dot density are shown in FIG. 4A as dot positions 100. For a given dot density, the various dot positions are in fixed locations along the stroke of the shuttle 14. Because the fence post pulses 98 also occur at fixed shuttle positions or locations along the stroke, the dot positions are therefore at fixed locations relative to the fence post pulses. As shown in FIG. 4A, the dot positions 100 typically occur at a different frequency from the frequency of the fence post pulses 98 so as to assume different positions within the fence periods. Moreover, because FIG. 4A is a plot with respect to time rather than distance, successive dot positions 100 within the acceleration region 68 and the deceleration region 76 are more widely spaced from each other than are the dot positions 100 within the constant velocity region 72 which are essentially equally spaced from each other.

In any event, each dot position 100 has a predetermined fixed position within one of the fence periods which can be expressed as a percentage of the total fence period at which the dot position occurs from the beginning or leading edge of the fence period. As described hereafter this is utilized in accordance with the invention to determine the timing of the dot positions in relation to the fence post pulses in the face of varying shuttle velocity.

The dot positions 100 shown in FIG. 4A represent one particular dot density. Many printers have the capability of printing with different dot densities. A different dot density than that represented by the dot positions 100 in FIG. 4A would result in a different set of dot positions thereon. Nevertheless, the dot positions of such different set would again have fixed positions within the fence periods which can be represented in terms of percentages.

Figure 4B:
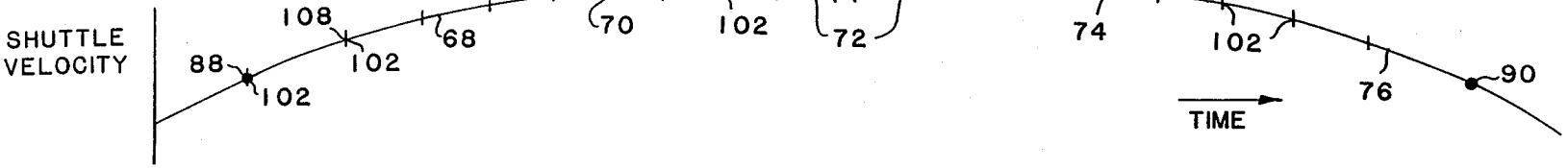
FIG. 4B is a plot of shuttle velocity along a stroke of the shuttle of the arrangement shown in FIG. 1 as a function of time.

The portion of the shuttle velocity profile of FIG. 3 which corresponds to the printing interval shown in FIG. 4A is reproduced in FIG. 4B. The points along the shuttle velocity profile of FIG. 4B at which the fence post pulses 98 occur are shown by intersecting lines 102 in FIG. 4B. It will be appreciated from FIG. 4B that as the shuttle velocity increases from the point 88 to the point 70 at which nominal operating velocity begins, the spacing between the lines 102 which defines the fence periods decreases to the nominal fence period which occurs between the points 70 and 74. During the deceleration region 76 the fence period as represented by the spacing between the lines 102 gradually increases.

In the present example the point 88 at which printing begins occurs at a shuttle velocity which is approximately 85% of the nominal operating velocity within the constant velocity region 72. Referring again to FIG. 4A which shows the fence post pulses 98, a first one 104 of the fence post pulses 98 is followed by a second one 106 of the fence post pulses 98. The first one 104 of the fence post pulses 98 occurs at the point 88 which is also shown in FIG. 4B and which is where a first one of the intersecting lines 102 occurs. The second one 106 of the fence post pulses 98 occurs at a second one 108 of the intersecting lines 102 shown in FIG. 4B. The change in shuttle velocity between the point 88 and the second one 108 of the intersecting lines 102 represents the greatest change in shuttle velocity that occurs during the printing region. The change in shuttle velocity between successive pairs of the fence post pulses 98 decreases up to the point 70 where nominal operating velocity begins. Throughout the constant velocity region 72 there is virtually no change in shuttle velocity between successive pairs of the fence post pulses 98.

It was previously noted that shuttle velocity at the point 88 is approximately 85% of the nominal operating velocity in the present example. Shuttle velocity at the second one 108 of the intersecting lines 102 is slightly less than 90% of the nominal operating velocity. Therefore, the change in shuttle velocity between occurrence of the first one 104 and the second one 106 of the fence post pulses 98 is slightly less than 5%. As noted, the change in shuttle velocity between subsequent pairs of fence post pulses is less. Within the deceleration region 76, the change in shuttle velocity between adjacent fence post pulses again increases to a maximum of just under 5% at the point 90.

Because the change in shuttle velocity during each fence period is no more than approximately 5% in the worst case, reasonably accurate timing of hammer firing can be achieved utilizing the average shuttle velocity during each fence period. As described hereafter the average shuttle velocity within each fence period is simply determined by measuring the time interval between the occurrence of each pair of fence post pulses 98 and storing a representation of that time interval which defines the fence period.

Figure 4C:
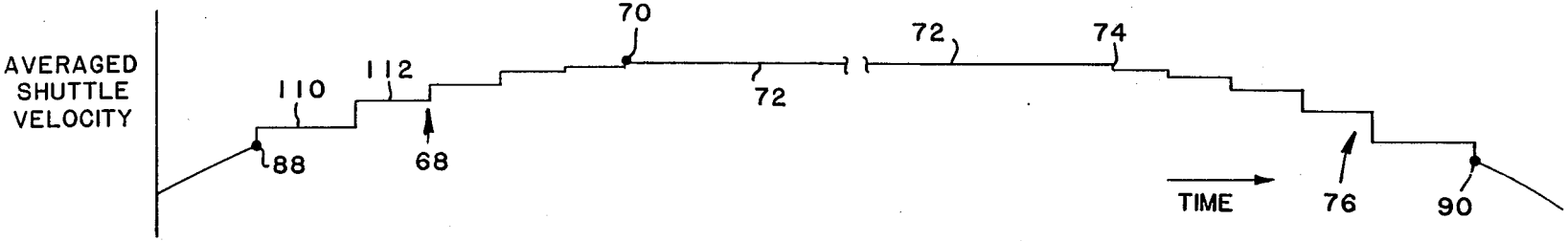
FIG. 4C is a plot of average shuttle velocity along a stroke of the shuttle of the arrangement shown in FIG.

The resulting average shuttle velocity is shown in FIG. 4C. As shown therein the shuttle 14 has an average velocity between the first and second ones 104 and 106 of the fence post pulses 98 which is represented by a horizontal line 110. The average shuttle velocity between the second one 106 of the fence post pulses 98 and the immediately following post fence pulse 98 is represented by a horizontal line 112. When the point 70 is reached, the nominal operating velocity begins, producing a continuous horizontal line between the points 70 and 74.

FIG. 5 depicts a portion of FIG. 4A comprising the first three fence periods which begin at the point 88 with the first one 104 of the fence post pulses 98. The first fence period is terminated with the occurrence of the second one 106 of the fence post pulses 98. The second fence period is defined by the interval between the second one 106 of the fence post pulses 98 and a third one 114 of the fence post pulses 98. The third fence period is defined by the interval between the third one 114 of the fence post pulses 98 and a fourth one 116 of the fence post pulses 98.

A first one 118 of the dot positions 100 occurs within the second fence period between the second one 106 and the third one 114 of the fence post pulses 98 as shown in FIG. 5. A second one 120 of the dot positions 100 occurs within the third fence period between the third one 114 and the fourth one 116 of the fence post pulses 98. A third one 122 of the dot positions 100 occurs immediately following the fourth one 116 of the fence post pulses 98.

To achieve accurate hammer fire timing, the occurrence of each of the dot positions 100 must be accurately predicted so that hammer firing can be initiated prior to that to allow for hammer flight time. Hammer flight time is a fixed time interval between initiation of hammer firing when a coil providing hammer release is first energized and the actual impacting of the print paper by the hammer to print the dot. In the present example, hammer flight time is 250 microseconds. It is therefore necessary that hammer firings be initiated at points which precede the dot positions 100 by 250 microseconds. At each of these points a hammer fire pulse is generated, resulting in initiation of the firing of those hammers on the shuttle 14 which are to print dots in the next one of the dot positions 100.

The generation of the hammer fire pulses must be related to the occurrence of the fence post pulses 98 which is the indication of actual position of the shuttle 14. Because the fence periods vary with shuttle velocity, the various dot positions 100 are expressed in terms of a percentage of the total distance through a particular one of the fence periods at which they occur. For example, the first one 118 of the dot positions 100 is known to occur at a point approximately 40% of the distance through the second fence period. Therefore, 40% of the time it takes the shuttle 14 to move between occurrence of the second one 106 of the fence post pulses 98 and occurrence of the third one 114 of the fence post pulses 98 must lapse following occurrence of the second one 106 of the fence post pulses 98 before the first one 118 of the dot positions 100 is reached. Similarly, the third one 120 of the dot positions 100 is represented as approximately 20% of the third fence period. This means that the second one 120 of the dot positions 100 occurs at a point approximately 20% of the distance through the third fence period between the third one 114 of the fence post pulses 98 and the fourth one 116 of the fence post pulses 98. Each of the dot positions 100 must therefore be defined in terms of a time lapse within their respective fence periods from the leading edge thereof and then adjusted by the hammer flight time to arrive at the points in time at which the hammer fire pulses must be generated.

In the case of the first one 118 of the dot positions 100 the time interval between the second one 106 of the fence post pulses 98 and the first one 118 of the dot positions 100 is determined in accordance with the fence period or time lapse between occurrence of the second one 106 of the fence post pulses 98 and the third one 114 of the fence post pulses 98 representing average shuttle velocity during the second fence period. Algebraically combining the hammer flight time with such time lapse locates a first hammer fire pulse 124 which occurs just before the second one 106 of the hammer fire pulses 98. Because the hammer fire pulses must be referenced to the occurrence of the fence post pulses 98, the immediately prior or first one 104 of the fence post pulses 98 is used as a reference in timing the generation of the first hammer fire pulse 124. The first fence period or time interval between occurrence of the first one 104 and the second one 106 of the fence post pulses 98 is known and represents the average shuttle velocity in the first fence period. Based on this a determination is made of $t_1$ which is the time lapse between the occurrence of the first one 104 of the fence post pulses 98 and the point at which the first hammer fire pulse 124 must be produced.

It was previously noted that the second one 120 of the dot positions 100 occurs at a point approximately 20% of the distance through the third fence period. Because the third fence period which represents the average shuttle velocity therein is known, the time lapse between occurrence of the third one 114 of the fence post pulses 98 and the second one 120 of the dot positions 100 can be determined and then algebraically combined with the hammer flight time so as to arrive at the location of a second hammer fire pulse 126 which precedes the third one 114 of the fence post pulses 98. The second fence period is known, enabling a determination of $t_2$ which is the time lapse between the occurrence of the second one 106 of the fence post pulses 98 and the second hammer fire pulse 126. A third hammer fire pulse 128 for printing at the third one 122 of the dot positions 100, and the time lapse $t_3$ between the third one 114 of the fence post pulses 98 and the third hammer fire pulse 128 is determined in similar fashion.

FIG. 6 depicts in basic block diagram form a circuit for controlling the printer arrangement of FIG. 1. The circuit of FIG. 6 includes a counter/timer 130 coupled to receive the fence post pulses from the encoder 52 and to provide hammer fire pulses to a plurality of hammer drivers 132.

As previously noted, the hammer fire pulses such as the pulses 124, 126 and 128 of FIG. 5 denote the points in time at which hammer release must be initiated in order to print dots at the various dot positions such as at the first, second, and third ones 118, 120 and 122 of the dot positions 100 shown in FIG. 5. The hammer drivers 132 include a plurality of magnetic print hammer actuators contained within the shuttle 14 and each being associated with a different hammer on the shuttle 14. Each magnetic print hammer actuator includes a coil which is energized whenever the hammer associated therewith is to be fired. The coils of the various magnetic print hammer actuators are energized by a circuit which responds to the hammer fire pulses from the counter/timer 130 to energize the coils of those print hammer actuators associated with hammers that are to be fired at each given dot position. Circuitry of this type is described in the previously referred to U.S. Pat. No. 3,941,051 of Barrus et al.

The counter/timer 130 provides the hammer fire pulses to the hammer drivers 132 in response to the fence post pulses from the encoder 52 under the control of a CPU 134 in conjunction with a program memory 136 and a random access memory (RAM) 138. The CPU 134 in combination with the program memory 136 and the RAM 138 comprises a processor with data storage capability which performs various functions described hereafter in conjunction with the counter/-time 130. A detailed example of circuitry comprising the CPU 134, the program memory 136 and the RAM 138 is provided by the previously referred to U.S. Pat. No. 4,415,286 of Jennings.

The processor comprised of the CPU 134, the program memory 136 and the RAM 138 functions in response to each startup of the printer 10 and to each change in the operation of the printer 10 involving a change in the nominal operating velocity of the shuttle 14 to measure and store the fence periods during a pair of strokes of the shuttle 14 in opposite directions. This is performed as soon as the shuttle 14 reaches the nominal operating velocity. Also stored within the processor are sets of values corresponding to different possible dot densities for the printer 10. Each set of dot density values comprises representations of the percentages defining the distances of the various dot positions into the various fence periods.

As described hereafter in connection with FIG. 7, the processor comprised of the CPU 134, the program memory 136 and the RAM 138 multiplies the stored intervals or fence periods representing average shuttle velocity by the percentages of the chosen dot density to determine the locations with respect to time of the various dot positions within the fence periods. These dot positions are adjusted in accordance with the hammer flight time to determine the hammer fire times which are stored. The counter/timer 130 responds to the fence post pulses from the encoder 52 and to the stored hammer fire times to provide the hammer fire pulses.

The processor comprised of the CPU 134, the program memory 136 and the RAM 138 also performs other functions for the printer 10 including servo control of the shuttle 14 in conjunction with the linear motor 16 to achieve the nominal constant velocity along the constant velocity regions 72 and 84.

A detailed example of an adaptive print hammer timing system in accordance with the invention and as provided by the CPU 134, the program memory 136 and the RAM 138 in conjunction with the counter/-timer 130 and the encoder 52 is shown in FIG. 7. As previously described, the encoder 52 responds to movement of the printer shuttle 14 by generating the fence post pulses. The fence post pulses are provided to a fence post identification circuit 140, a CPU interrupt 142 and a hammer fire timer 144. The fence post identification circuit 140 identifies each of the fence post pulses 98 from the encoder 52 in terms of which fence post pulse 98 it is and the direction of movement of the shuttle 14. This information is provided to a dynamic hammer fire time table 146, to a dynamic fence period table 148 and to a static dot position table 150.

Whenever velocity information for the shuttle 14 is to be updated such as upon startup of the printer 10 or upon a change in the mode of operation of the printer 10, the CPU interrupt 142 communicates with the CPU 134 shown in FIG. 6 to initiate storage of the fence periods for each of a pair of opposite strokes of the shuttle 14. This operation is initiated as soon as the shuttle 14 has reached a nominal operating velocity. The fence period timer 152 measures the time interval between the occurrences of each pair of fence post pulses to determine the fence periods which are then stored in the dynamic fence period table 148.

The static dot position table 150 stores information representing each of the different dot positions 100 for each of several different sets of possible dot densities for the printer 10. As previously noted, each dot position is represented by a percentage denoting the location of the dot position within one of the fence periods. Depending upon the particular dot density being used, representations of the various percentages for that density which are stored in the static dot position table 150 are multiplied by the values of the corresponding fence periods stored in the dynamic fence period table 148 by a multiplier 154 to provide the dynamic dot positions. The dynamic dot positions are then algebraically combined with the hammer flight time by an adder 156 which is coupled to provide hammer fire times to the dynamic hammer fire time table 146.

Thus, the fence period timer 152 under the control of the CPU interrupt 142 determines each fence period by determining the time lapse between occurrences of the fence post pulses defining such fence period, and then storing a representation of each fence period in the dynamic fence period table 148. In the example of FIG. 5, the time intervals between the first, second, third and fourth fence post pulses 104, 106, 114 and 116 defining the first three fence periods of the shuttle stroke in that direction are determined by the fence period timer 152 and then stored in the dynamic fence period table 148 as are the following fence periods during the shuttle stroke and the following shuttle stroke. The location of th first one 118 of the dot positions 100 is then determined by multiplying the second fence period in which the first one 118 of the dot positions 100 occurs by the percentage corresponding to the first one 118 of the dot positions 100 which is stored in the static dot position table 150. The multiplication is performed by the multiplier 154 to determine the dynamic dot position which is provided to the adder 156 together with the hammer flight time of 250 microseconds in the present example. The adder 156 effectively moves the dynamic dot position forward by the hammer flight time so as to arrive at a hammer fire time for producing the first hammer fire pulse 124. This is done by algebraically combining the hammer flight time with the dynamic dot position. The hammer fire time falls within the first fence period and is referenced to the first one 104 of the fence post pulses 98 by the time interval $t_1$. This hammer fire time is stored in the dynamic hammer fire time table 146 as the value of $t_1$ and an identification of the first one 104 of the fence post pulses 98 which precedes it.

The dynamic hammer fire time table 146 represents each dot position in terms of a hammer fire time which is referenced to the immediately preceding fence post pulse. As the occurrence of each new fence post pulse is identified by the fence post identification circuit 140 during printing, the hammer fire times stored in the dynamic hammer fire time table 146 which are referenced to the next fence post pulse are loaded into the hammer fire timer 144. When the next fence post pulse is then identified by the fence post identification circuit 140, the hammer fire timer 144 begins counting down in accordance with the hammer fire time or times corresponding to that fence period so as to produce the hammer fire pulses at the appropriate times. As previously discussed, the hammer fire pulses are provided to the hammer drivers 132 shown in FIG. 6 to initiate the firing of those hammers being used to print dots in the various dot positions.

The arrangement shown in FIG. 7 functions in a similar manner to determine the hammer fire time for each dot position 100. In the case of the second one 120 of the dot positions 100, the third fence period between the third one 114 and the fourth one 116 of the fence post pulses 98 is multiplied by the percentage for the second one 120 of the dot positions 100 stored in the static dot position table 150 by the multiplier 154 to provide the dynamic dot position thereof. The dynamic dot position is then algebraically combined with the hammer flight time by the adder 156 to provide the hammer fire time $t_2$ which produces the second hammer fire pulse 126 toward the end of the second fence period. In the case of the third one 122 of the dot positions 100, the fence period in which the third one 122 of the dot positions 100 occurs is multiplied by the corresponding percentage stored in the static dot position table 150 by the multiplier 154 to provide the dynamic dot position. Such dynamic dot position is then algebraically combined with the hammer flight time by the adder 156 to produce the appropriate hammer fire time which is stored in the dynamic hammer fire time table 146 as the time interval $t_3$ to produce the third hammer fire pulse 128.

Thus, each time the printer 10 is started up or the nominal operating velocity of the shuttle 14 is changed such as due to a mode change, all of the fence periods are measured and stored and the hammer fire times for a given dot density being used are re-calculated. As soon as the shuttle 14 reaches the nominal operating velocity, the CPU interrupt 142 causes the fence period timer 152 to time each fence period representing the average shuttle velocity therein and store such times in the dynamic fence period table 148. Each time as so stored in the dynamic fence period table 148 is then multiplied by the percentages stored in the static dot position table 150 for the given dot density using the multiplier 154 to determine the dynamic dot positions. The dynamic dot positions are algebraically combined with the fixed hammer flight time by the adder 156 to provide the hammer fire times which are stored in the dynamic hammer fire time table 146 as times from the preceding fence post pulses. These times are loaded in the hammer fire timer 144 in advance of the occurrence of each of the preceding fence post pulses, and the hammer fire timer 144 thereafter counts down by the times so as to produce the hammer fire pulses at the appropriate times.

While there have been described above and illustrated in the drawings a number of variations, modifications and alternative forms, it will be appreciated that the scope of the invention defined by the appendant claims includes all forms comprehended thereby.

What is claimed:

1. In a printer in which a plurality of hammers on a reciprocating shuttle are selectively fired to perform impact printing, a timing circuit for determining hammer firing positions during each stroke of the reciprocating shuttle comprising the combination of:

means for sensing the actual position of the shuttle at each of a succession of locations along a path of movement thereof;

means for defining successive intervals of movement of the shuttle between the succession of locations along the path of movement in response to said sensing of the actual position of the shuttle during each stroke;

means responsive to startup of the printer for storing separate values of the time interval of travel of the shuttle through each of the successive intervals of movement; and means responsive to arrival of the shuttle at each of the succession of locations along the path of movement therefor representing the beginning of the successive intervals of movement of the shuttle during each stroke and responsive to the stored separate value of the time interval of travel of the shuttle through that interval of movement for providing hammer firing position signals, the hammer firing position signals being adjusted in terms of their time of occurrence in accordance with the stored separate values.

2. The invention set forth in claim 1, wherein the means responsive to startup of the printer for storing separate values is operative to store separate information representing average shuttle velocity during each of the successive intervals of movement.

3. The invention set forth in claim 1, wherein the means responsive to startup of the printer for storing separate values is also operative to store separate shuttle velocity information pertaining to each of the successive intervals in response to a change in the operation of the printer in which a change in a nominal operating velocity of the shuttle occurs.

4. A printer comprising the combination of:

an elongated shuttle mounted adjacent a print station, the shuttle having a plurality of dot printing hammers mounted along the length thereof;

means for driving the shuttle in reciprocating fashion relative to the print station such that the shuttle undergoes a succession of strokes of opposite direction relative to the print station, the shuttle accelerating from rest to a nominal operating velocity and then decelerating to rest during each stroke;

an encoder coupled to the shuttle for providing a succession of shuttle position pulses during each stroke of the shuttle, the shuttle position pulses representing essentially equal increments of movement of the shuttle and being generated while the shuttle is accelerating and decelerating as well as moving at the nominal operating velocity upon the arrival of the shuttle at each of a plurality of locations along a path of movement of the shuttle;

means for separately storing time values representing the time lapse between the occurrence of each pair of the shuttle position pulses during a stroke of the shuttle;

means for determining portions of the stored time values representing the occurrence of dot printing positions between the pairs of shuttle position pulses;

means for combining a fixed hammer flight time with each of the determined portions of the stored time to determine a hammer fire time with reference to a preceding one of the shuttle position pulses for each of a plurality of the dot printing positions; and means responsive to the hammer fire times and to the occurrence of the shuttle position pulses for providing hammer fire signals during each stroke of the shuttle.

5. The invention set forth in claim 4, wherein the means for separately storing time values representing the time lapse between the occurrence of each pair of shuttle position pulses during a stroke of the shuttle is operative to determine and store such values each time the printer is started up.

6. The invention set forth in claim 5, wherein the means for separately storing time values representing the time lapse between the occurrence of each pair of shuttle position pulses during a startup of the shuttle is also operative to determine and store such values each time there is a change in the operation of the printer involving a change in the nominal operating velocity of the shuttle.

7. The invention set forth in claim 4, wherein the means for determining portions of the stored time values representing the occurrence of dot printing positions between the pairs of shuttle position pulses determines such portions by determining predetermined percentages of the stored time values representing the occurrences of the dot positions during the intervals between the occurrences of the pairs of shuttle position pulses.

8. The invention set forth in claim 7, wherein the means for separately storing time values representing the time lapse between the occurrence of each pair of the shuttle position pulses during a stroke of the shuttle includes a timer coupled to the encoder for timing the interval between the occurrences of each pair of the shuttle position pulses and a storage table coupled to the timer for storing the times intervals from the timer.

9. The invention set forth in claim 8, wherein the means for determining portions of the stored time values representing the occurrence of the dot printing positions between the pairs of shuttle position pulses comprises a dot position table for storing values representing the predetermined percentages and a multiplier coupled to the dot position table for multiplying the timed intervals stored in the storage table by the stored values in the dot position table to provide a plurality of dynamic dot position values.

10. The invention set forth in claim 9, wherein the means for combining a fixed hammer flight time with each of the determined portions of the stored times comprises an adder for combining a hammer flight time value with each of the plurality of dynamic dot position values to provide a plurality of hammer fire time values and a dynamic hammer fire time table for storing the plurality of hammer fire time values.

11. The invention set forth in claim 10, wherein the means responsive to the hammer fire times and to the occurrence of the shuttle position pulses for providing hammer fire signals during each stroke of the shuttle comprises a hammer fire timer coupled to the dynamic fire time table and responsive to the occurrence of each shuttle position pulse to load a corresponding hammer fire time value therein, the hammer fire timer counting down by the value of the hammer fire time value loaded therein and then producing a hammer fire pulse.

12. A method of timing the firing of a plurality of hammers on a shuttle as the shuttle undergoes reciprocating movement in successive strokes of opposite direction, the shuttle velocity during each stroke being characterized by acceleration from rest to a nominal operating velocity followed by deceleration to rest, comprising the steps of:

generating from the sensed travel of the shuttle a succession of fence post pulses as the shuttle undergoes each stroke, the fence post pulses corresponding to the sensing of the actual positioning of the shuttle at each of a succession of generally equally spaced locations along the stroke;

separately determining the time of travel of the shuttle between each pair of fence post pulses;

defining the locations of a plurality of dot positions along the stroke relative to the pairs of the fence post pulses in terms of portions of the times of travel of the shuttle between each pair of fence post pulses at which the dot positions occur; and determining hammer firing points along the stroke by determining the time of occurrence of each dot position in accordance with a portion of the separately determined time of travel of the shuttle between the adjacent pair of fence post pulses in which the dot position is located and then preceding the time of occurrence of each dot position by a fixed hammer flight time.

13. The method set forth in claim 12, wherein the step of determining the time of travel of the shuttle between each pair of fence post pulses comprises separately measuring the time interval between the occurrence of each pair of fence post pulses to determine the average velocity of the shuttle therebetween.

14. The method set forth in claim 12, wherein the step of separately determining the time of travel of the shuttle between each pair of fence post pulses comprises the steps of measuring the time lapses between the occurrence of pairs of fence post pulses and storing the measured time lapses, the step of defining the location of a plurality of dot positions along the stroke relative to the pairs of fence post pulses in terms of portions of the time of travel of the shuttle between each pair of fence post pulses at which the dot positions occur includes determining the percentages of the total times between the pairs of the fence post pulses at which the dot positions occur, and the step of determining hammer firing points along the stroke includes the steps of multiplying the stored measured time lapses by the percentages to obtain products and adjusting each product by the fixed hammer flight time.

15. The method set forth in claim 12, wherein the step of separately determining the time of travel of the shuttle between each pair of fence post pulses is performed upon startup of the printer.

16. The method set forth in claim 12, wherein the step of separately determining the time of travel of the shuttle between each pair of fence post pulses is also performed upon a change in the operation of the printer involving a change in the nominal operating velocity of the shuttle.

* * * * *